US007338306B1

(12) United States Patent
Chen

(10) Patent No.: US 7,338,306 B1
(45) Date of Patent: Mar. 4, 2008

(54) ELECTRIC CONNECTOR HAVING POWER CABLE RETAINING STRUCTURE

(75) Inventor: Tsang-I Chen, Taipei (TW)

(73) Assignee: Swain Industry Co., Ltd., Taipei (TW)

( * ) Notice: Subject to any disclaimer, the term of this patent is extended or adjusted under 35 U.S.C. 154(b) by 14 days.

(21) Appl. No.: 11/485,290

(22) Filed: Jul. 13, 2006

(51) Int. Cl.
*H01R 13/62* (2006.01)

(52) U.S. Cl. ..... 439/320

(58) Field of Classification Search ..... 439/320, 439/469; 339/103
See application file for complete search history.

(56) References Cited

U.S. PATENT DOCUMENTS 4,178,056 A * 12/1979 Lee ..... 439/472
5,167,527 A * 12/1992 Clark ..... 439/469
5,358,429 A * 10/1994 Mina ..... 439/695
5,641,310 A * 6/1997 Tiberio, Jr. ..... 439/680
6,739,900 B2 * 5/2004 Mortun et al. ..... 439/469

* cited by examiner

*Primary Examiner*—Tulsidas C. Patel
*Assistant Examiner*—Vladimir Imas
(74) *Attorney, Agent, or Firm*—Browdy and Neimark, PLLC

(57) ABSTRACT

An electric connector includes a connector body having contact terminals mounted in a first end thereof and an axial through hole axially formed in a second end thereof opposite to the first end. A power cable is inserted into the axial through hole of the connector body and electrically connected to the contact terminals. Two retaining members are transversely mounted in the connector body and engaged at two opposite sides of the power cable to hold the power cable in the axial through hole of the connector body. The retaining members are movable relative to each other to adjust a pitch therebetween subject to a diameter of the power cable.

5 Claims, 7 Drawing Sheets

ELECTRIC CONNECTOR HAVING POWER CABLE RETAINING STRUCTURE

BACKGROUND OF THE INVENTION

1. Field of the Invention

The present invention relates generally to electric connectors, such as electric sockets or electric plugs, and more particularly to an electric connector having a power cable retaining structure.

2. Description of the Related Art

Conventional electric connectors, either electric plugs or electric sockets, commonly comprise a connector body and a power cable. The connector body holds positive and negative terminals that are respectively soldered to the positive and negative poles of the power cable by means of a respective metal conductive plate. Further, a stop member is capped on the power cable to fix the power cable in position, preventing disconnection of the power cable from the metal conductive plates to break the circuit when the power cable is stretched. This design of using a stop member to fix the position of the power cable is still not satisfactory in function. For example, when a different diameter of power cable is used, a different size of stop member shall be installed, i.e., one stop member cannot fit cables of different diameters.

Further, if an electric plug or socket does not provide an effective water resistant means, water may enter the inside of the connector body to wet the internal circuit and to further cause the electric apparatus to break down or to leak out electricity, and the user may be shocked when touching the wet electric plug or socket.

SUMMARY OF THE INVENTION

The present invention has been accomplished under the circumstances in view. It is one object of the present invention to provide an electric connector assembly, which uses two pitch-adjustable retaining members to hold down any of a series of power cables of different diameters, keeping the installed power cables tightly secured to the connector body.

It is another object of the present invention to provide an electric connector assembly, which has a stop flange extending around the periphery to prohibit outside water from entering the inside of the electric connector assembly, preventing a short-circuit.

To achieve these objects of the present invention, the electric connector comprises a connector body having at least two contact terminals at a first end thereof, and an axial through hole axially formed in a second end thereof opposite to the first end; a power cable inserted into the axial through hole of the connector body and electrically connected to the contact terminals; and two retaining members transversely mounted in the connector body at two sides and engaged at two opposite sides of the power cable so as to hold the power cable in the axial through hole of the connector body. The retaining members are movable relative to each other to adjust a pitch therebetween subject to a diameter of the power cable. The connector body further comprises a flat panel extending around the periphery thereof, a coupling portion extending from one side of the flat panel and forming the first end for the connection of an external electric connector, the coupling portion defining therein a receiving chamber that accommodates the contact terminals, and a stop flange extending from the flat panel around the coupling portion for guiding outside water away from the connector body. The stop flange has a proximity end connected to the flat panel and a distal end far away from the flat panel. The proximity end has a diameter smaller than the distal end for prohibit water from entering the receiving chamber.

DETAILED DESCRIPTION OF THE INVENTION

Figure 1:
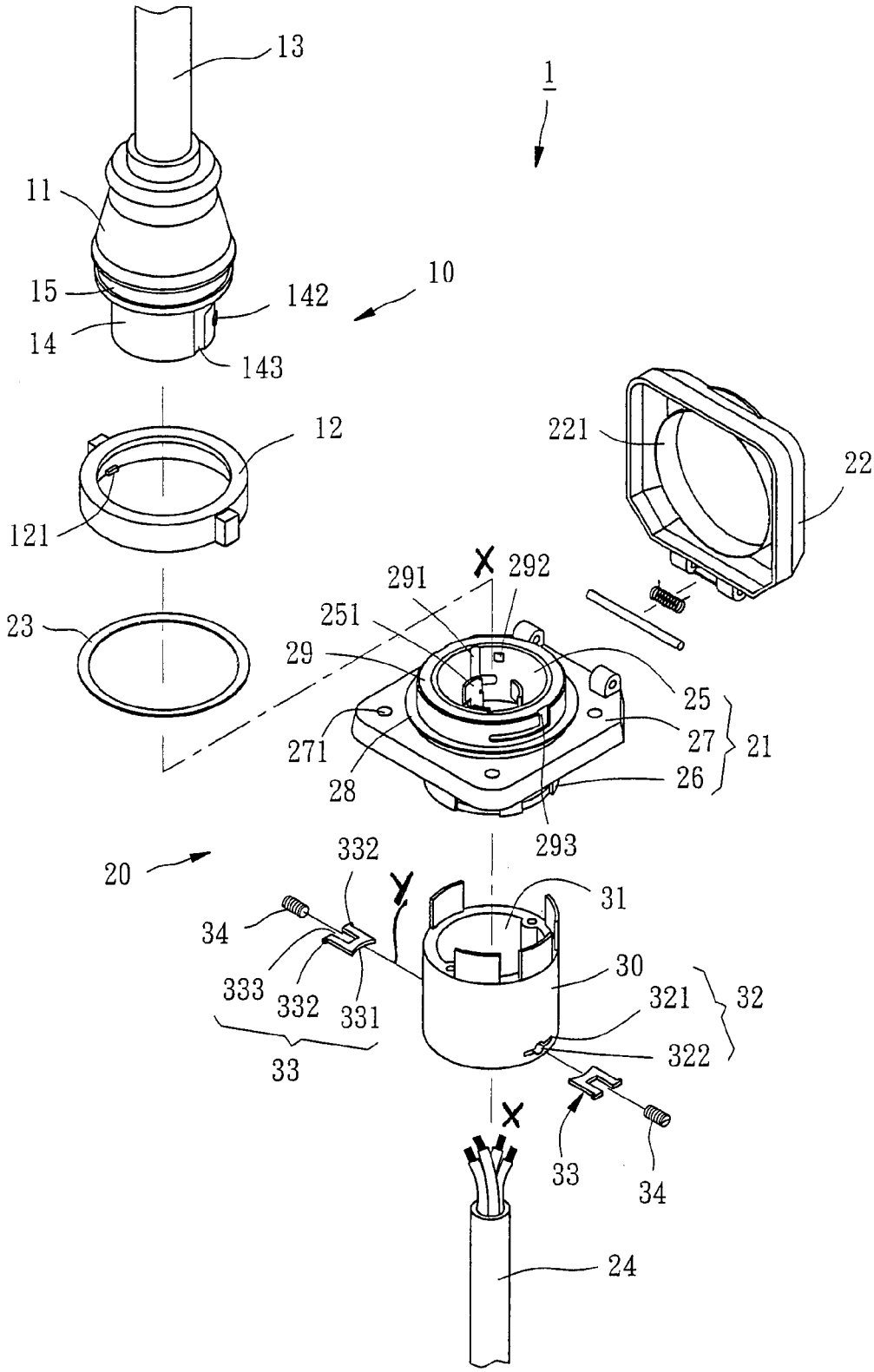
FIG. 1 is an exploded view of an electric connector assembly in accordance with a preferred embodiment of the present invention.
Figure 2:
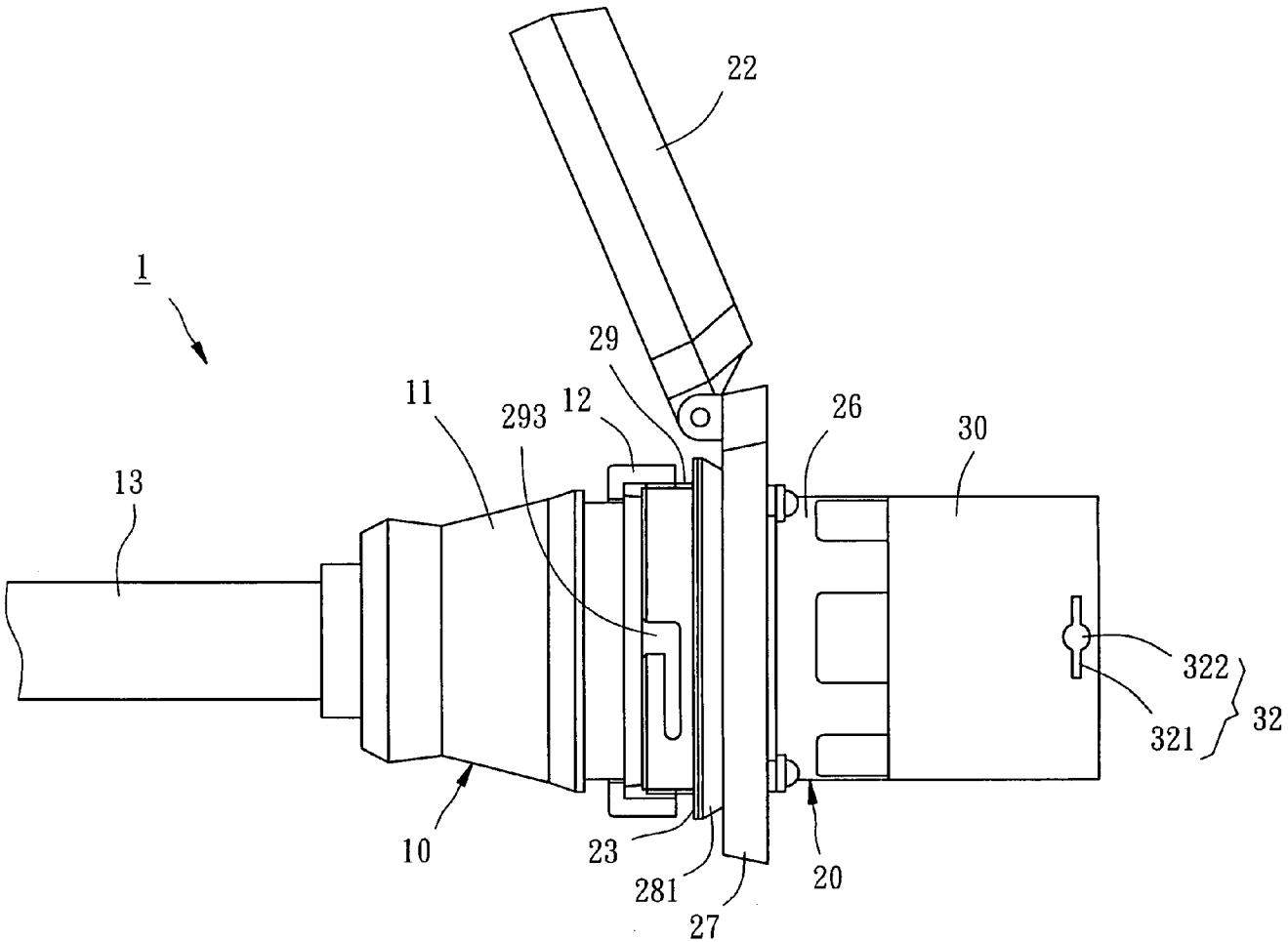
FIG. 2 is an assembly view of the electric connector assembly in accordance with the preferred embodiment of the present invention.
Figure 3:
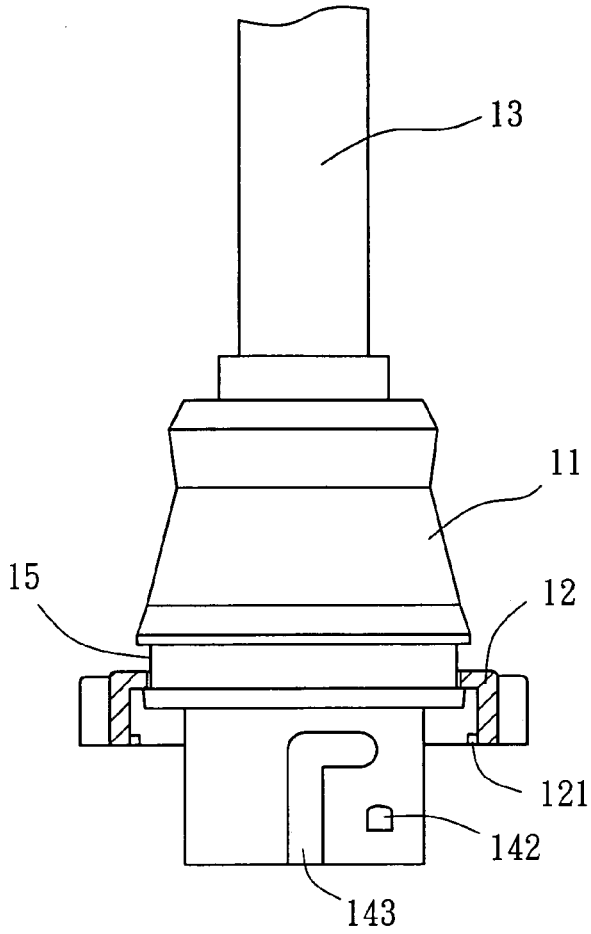
FIG. 3 is a schematic plain view of the electric socket of the electric connector assembly in accordance with the preferred embodiment of the present invention.
Figure 4:
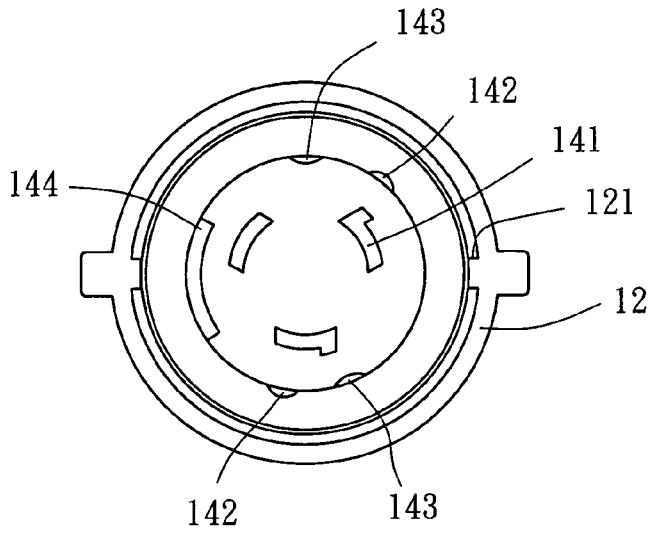
FIG. 4 is a bottom view of the electric socket of the electric connector assembly in accordance with the preferred embodiment of the present invention.
Figure 5:
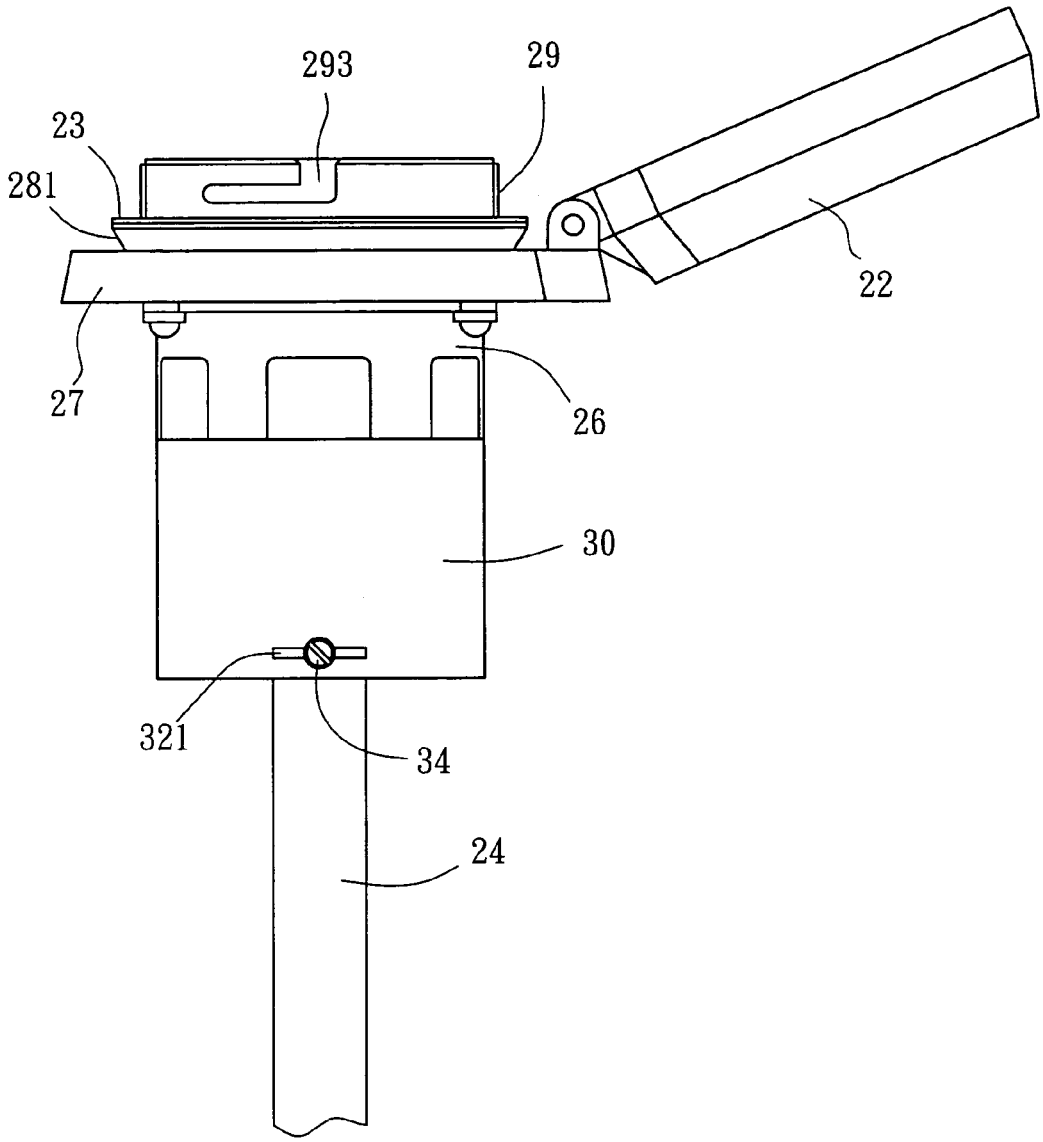
FIG. 5 is a schematic plain view of the electric plug of the electric connector assembly in accordance with the preferred embodiment of the present invention.
Figure 6:
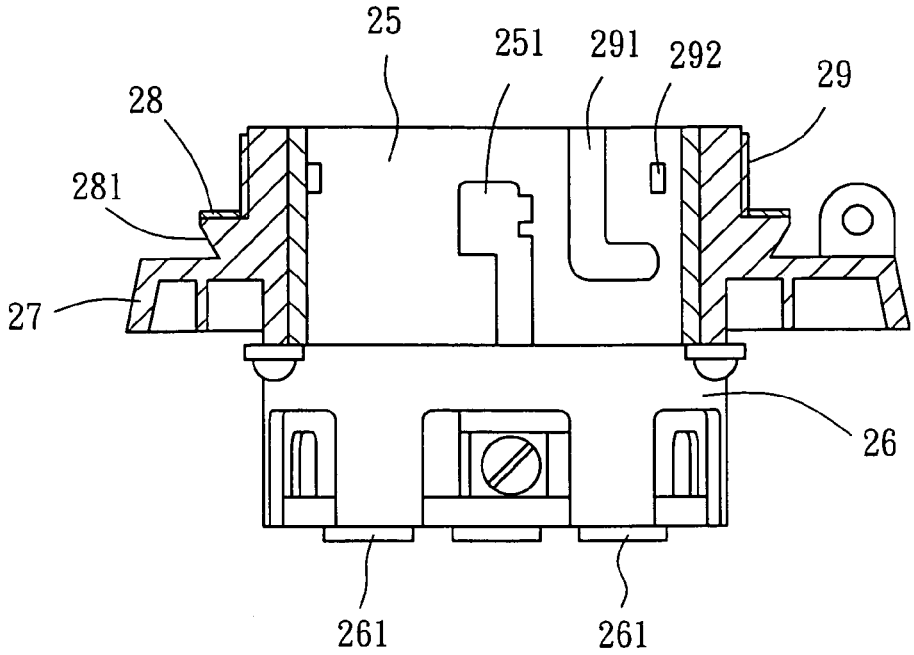
FIG. 6 is a sectional view of a part of the electric plug of the electric connector assembly according to the preferred embodiment of the present invention.

As shown in FIGS. 1-9, an electric connector assembly 1 in accordance with a preferred embodiment of the present invention comprises a pair of coupled electric connectors, namely a female electric connector, i.e. an electric socket 10, and a male electric connector, i.e. an electric plug 20. In this embodiment, the power cable retaining structure is shown applied to the electric plug only for easy illustration purpose.

Referring to FIGS. 1-4, the electric socket 10 comprises a socket body 11, a coupling member 12, and a power cable 13. The socket body 11 has a coupling portion 14 axially forwardly extended from the front side thereof, and a locating groove 15 extending around the periphery. The coupling portion 14 has three terminal slots 141 each holding a respective conductive terminal (not shown), and two raised portions 142 and two L-shaped grooves 143 and a guide rib 144 respectively formed on the periphery thereof. The coupling member 12 is coupled to the locating groove 15 of the socket body 11 and rotatable relative to the socket body 11, having two raised portions 121 bilaterally protruded from the inside wall thereof. The power cable 13 has one end inserted into the socket body 11 and electrically connected to the conductive terminals in the terminal slots 141.

Referring to FIGS. 1, 2 and 5-10, the electric plug 20 comprises a plug body 21, a cover 22, a gasket ring 23, and a power cable 24. The plug body 21 comprises a receiving chamber 25 at one side, a holder frame 26 at an opposite side, a flat panel 27 extending around the periphery on the middle between the receiving chamber 25 and the holder frame 26, a coupling portion 29 extending from one side of the flat panel 27 and surrounding the receiving chamber 25, a stop flange 28 extending from the flat panel 27 around the coupling portion 29, a plurality of connection portions 261 at the holder frame 26 through which the power cable 24 is inserted into the plug body 21, three contact terminals 251 mounted inside the receiving chamber 25 and respectively connected to the power cable 24 that is inserted through the holder frame 26 into the receiving chamber 25, and a plurality of mounting through holes 271 provided at the flat panel 27 for the mounting of fastening members (not shown) to affix the flat panel 27 to the wall. The stop flange 28 is a conical stop flange having a tapered outer wall 281 sloping downwardly inwards, i.e., the tapered outer wall 281 has a diameter gradually reducing in direction from the coupling portion 29 toward the flat panel 27. The gasket ring 23 is mounted on the stop flange 28. The coupling portion 29 has two L-shaped grooves 291, two raised portions 292 and a guide rib (not shown) on the inside wall thereof, and two L-shaped grooves 293 on the outside wall thereof. The cover 22 is coupled to one side of the flat panel 27 and adapted to cover the receiving chamber 25, coupling portion 29 and stop flange 28 of the plug body 21, having a press portion 221. When the cover 22 is closed, the press portion 221 is pressed on the gasket ring 23 against the stop flange 28 to seal the receiving chamber 25 against outside water and dust.

A locating member 30 is fastened to the holder frame 26 of the plug body 21, having an axial through hole 31 cut through the two distal ends thereof for the passing of the power cable 24, two stop portions 323 bilaterally disposed inside the axial through hole 31 on the middle, and two cut-through portions 32 at two sides of the periphery. Each cut-through portion 32 is comprised of an elongated slot 321 and a screw hole 322 at the center of the elongated slot 321. Further, two retaining members 33 are respectively mounted in the elongated slots 321 of the cut-through portions 32 which, as shown in FIG. 1, adjustably extend through opposite side walls of locating member 30 on a line Y perpendicular to and through the axis X-X of the location member 30 along the length of the two retaining members 33. Each retaining member 33 has an arched retaining portion 331 disposed at one end and stopped against the periphery of the power cable 24 inside the axial through hole 31, two positioning portions 332 disposed at the other end and stopped at the associating stop portion 323, and a recessed mounting portion 333 defined between the two positioning portions 332. Further, a fastening member, for example, a screw rod 34 is threaded into the screw hole 322 of each cut-through portion 32 and the recessed mounting portion 333 of the associating retaining member 33 and rotated to adjust the engagement between the respective retaining member 33 and the power cable 24 and to prevent disconnection of the power cable 24 from the contact terminals 214 when the power cable 24 is stretched by an external force. According to this embodiment, the locating member 30 is an independent member connected to the holder frame 26 of the connector body 21. Alternatively, the locating member 30 can be formed integral with a part of the holder frame 26 of the connector body 21.

Referring to FIGS. 2-7 again, when the contact terminals 251 of the electric plug 20 are respectively inserted into the terminal slots 141 of the electric socket 10, the contact terminals 251 are kept in contact with the conductive terminals of the electric socket 10 respectively, the guide rib 143 of the coupling portion 14 is stopped at the guide rib in the coupling portion 29, the raised portions 142 of the coupling portion 14 are respectively inserted into the L-shaped grooves 291 of the coupling portion 29, and the raised portions 292 of the coupling portion 29 are respectively inserted into the L-shaped grooves 143 of the coupling portion 14. When rotating the electric socket 10 relative to the electric plug 20 at this time subject to the extending direction of the L-shaped grooves 291, the raised portions 142 of the coupling portion 14 are respectively engaged with (the respective transverse sections) of the L-shaped grooves 291 of the coupling portion 29, and the raised portions 292 of the coupling portion 29 are respectively engaged with (the respective transverse sections) of the L-shaped grooves 143 of the coupling portion 14, and therefore the electric socket 10 and the electric plug 20 are firmly secured together. At this time, the coupling member 12 is rotated through an angle to force the raised portions 121 into engagement with the L-shaped grooves 293 of the coupling portion 29, keeping the coupling member 12 secured to the coupling portion 29 and stopped at the gasket ring 23 against the stop flange 28. Therefore, the gasket ring 23 and the tapered outer wall 281 of the stop flange 28 effectively seal the gap between the electric socket 10 and the electric plug 20. Further, when the electric plug 20 is not used, the cover 22 is closed to seal the receiving chamber 25 against outside moisture and dust.

Figure 8:
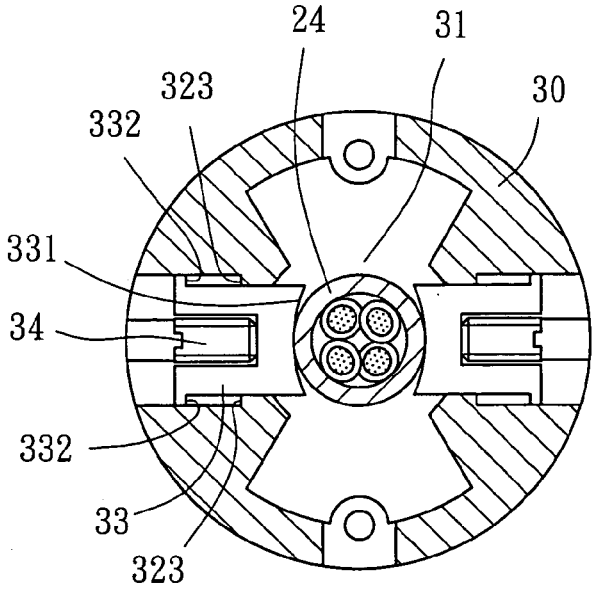
FIG. 8 is a schematic bottom view of an electric connector assembly in accordance with the preferred embodiment of the present invention.
Figure 7:
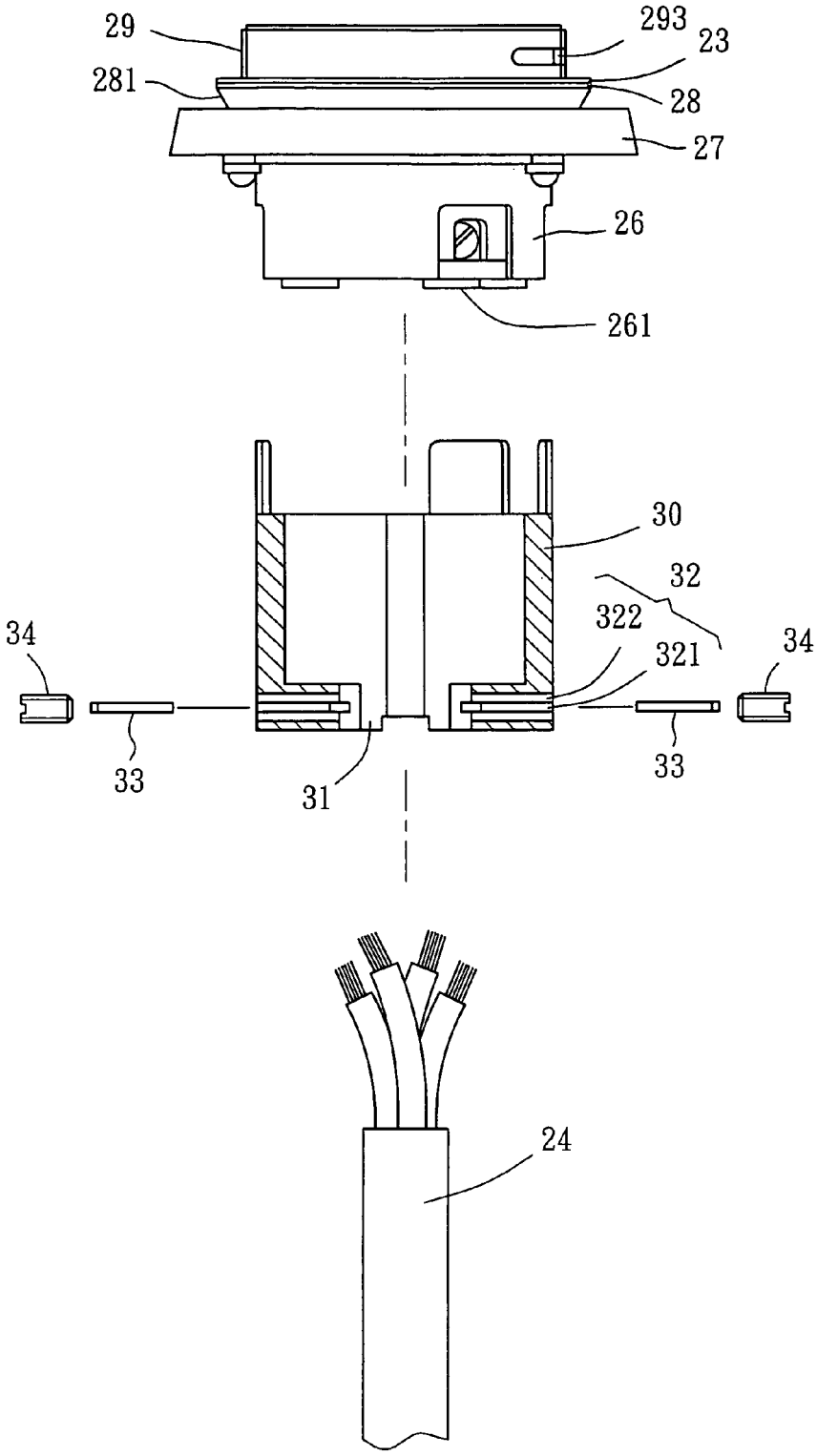
FIG. 7 is an exploded view, partially in section, of the electric plug of the electric connector assembly in accordance with the preferred embodiment of the present invention.
Figure 9:
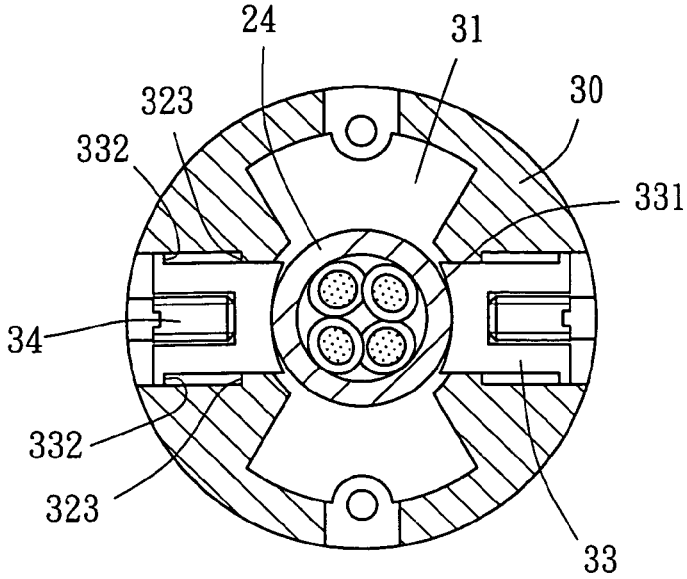
FIG. 9 is similar to FIG. 8 but showing a relatively bigger power cable used.

Referring to FIGS. 8 and 9, the two retaining members 33 are respectively forced into engagement with the periphery of the power cable 24 by the screw rods 34 to hold down the power cable 24 firmly in position. By means of rotating the screw rods 34 inwards/outwards, the insertion depth of the retaining members 33 in the respective cut-through portions 32 is relatively adjusted subject to the diameter of the power cable 24, enabling the retaining members 33 to hold down the power cable 24 tightly. Further, as stated above, each retaining member 33 has two positioning portions 332 which can be stopped at the associating stop portion 323, therefore the retaining members 33 are prohibited from falling out of the cut-through portions 32. Further, because the retaining portion 331 of each retaining member 33 is smoothly arched, it fits tightly the normally circular periphery of the power cable 24. Therefore, the retaining members 33 can hold down any of a series of power cables of diameters within a predetermined range, preventing disconnection of the installed power cable from the contact terminals 251, preventing an open circuit due to disconnection of the power cable 24 from the contact terminals 251.

Figure 10:
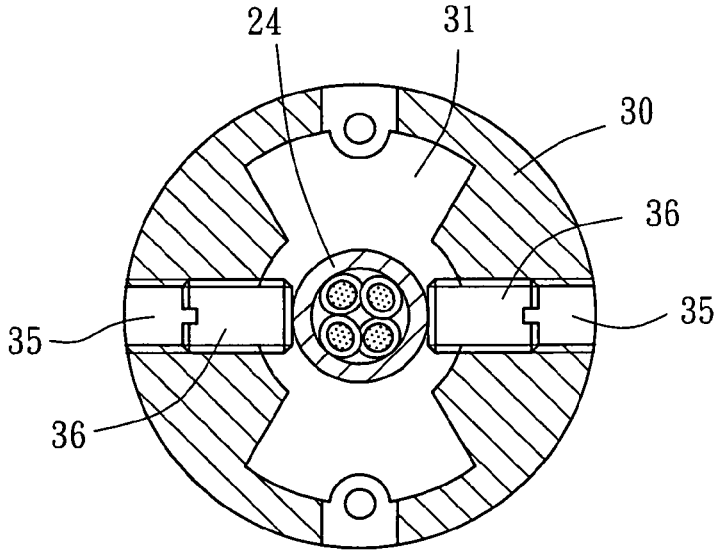
FIG. 10 is a bottom view of an alternate form of electric connector assembly according to the present invention.

FIG. 10 shows an alternate form of the present invention. According to this embodiment, the cut-through portions 32 of the locating member 30 are screw holes 35, and screw rods 36 served as the retaining members are respectively threaded into the screw holes 35 to hold down the power cable 24 in the axial through hole 31 of the locating member 30. By means of rotating the screw rods 36 inwards/outwards in the screw holes 35, the screw rods 36 fit the diameter of the power cable 24, i.e., the screw rods 36 can hold down any of a series of power cables 24 of different diameters within a predetermined range.

As indicated above, the power cable is firmly clamped in the electric plug by two retaining members which are moveable toward each other to adjust a pitch therebetween for fitting the diameter of the power cable. Although the power cable retaining structure of the present invention is applied in the male electric connector, i.e. the electric plug in the aforesaid embodiments, it is to be easily understood that the power cable retaining structure can also be applied in the female electric connector, i.e. the electric socket. Accordingly, the invention is not to be limited to aforesaid embodiments except as by the appended claims.

What is claimed is:

1. An electric connector comprising:

a connector body having an axial through hole with at least two contact terminals engaged in said through hole;

a power cable engaged in said through hole and electronically connected to said contact terminals;

two retaining members engaged to and adjustably extending through opposite side walls of said connector body on a line perpendicular to and through the axis of said connector body along the length of said two retaining members;

wherein each of said two retaining members can be respectively moved along the length thereof through said opposite side walls relative to each other to adjust a space between opposite ends of said two retaining members to be equal in length to that of a diameter of the power cable engaged between the opposite ends of said two retaining members in said through hole.

2. The electric connector as claimed in claim 1, wherein said connector body has a locating member disposed at the second end, said locating member defining said axial through hole and having two cut-through portions through which said retaining members adjustably extend.

3. The electric connector assembly as claimed in claim 2, wherein said cut-through portions of said locating member each comprise an elongated slot and a screw hole at a center of said elongated slot; said locating member of said connector body has two stop portions respectively disposed corresponding to the elongated slots of said cut-through portions; said retaining members are respectively inserted into the elongated slots of said cut-through portions, each having an arched front end retaining portions for engaging said power cable, two rear positioning portions for stopping the stop portions of said locating member, and a mounting portion defined between said rear positioning portions; two adjustment screw members are respectively threaded into the screw holes of said cut-through portions and contacted with the mounting portions of said retaining members to force the arched front end retaining portions of said retaining members into engagement with said power cable.

4. The electric connector assembly as claimed in claim 2, wherein said cut-through portions are screw holes; said retaining members are screw rods respectively threaded into the screw holes of said cut-through portions and stopped against said power cable to hold said power cable in said axial through hole.

5. The electric connector assembly as claimed in claim 1, wherein said connector body comprises a flat panel, a coupling portion extending from one side of said flat panel and defining therein a receiving chamber for accommodating the contact terminals, and a stop flange extending from said flat panel around said coupling portion, said stop flange having a proximity end connected to said flat panel and a distal end far away from said flat panel, said proximity end having a diameter smaller than said distal end for prohibit water from entering the receiving chamber.

* * * * *